US007452647B2

(12) United States Patent
Hayami et al.

(10) Patent No.: US 7,452,647 B2
(45) **Date of Patent: *Nov. 18, 2008**

(54) COLOR TONER

(75) Inventors: Kazuhiko Hayami, Ibaraki (JP); Hirohide Tanikawa, Shizuoko (JP); Tetsuya Ida, Shizuoka (JP); Akira Hashimoto, Shizuoka (JP); Nozomu Komatsu, Shizuoka (JP); Hiroyuki Fujikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/817,879

(22) Filed: Apr. 6, 2004

(65) Prior Publication Data

US 2004/0197694 A1 Oct. 7, 2004

(30) Foreign Application Priority Data

Apr. 7, 2003 (JP) ..... 2003-102581
Dec. 15, 2003 (JP) ..... 2003-416170

(51) Int. Cl.
*G03G 9/087* (2006.01)

(52) U.S. Cl. ..... 430/109.4; 430/110.3

(58) Field of Classification Search ..... 430/109.4, 430/110.3, 18, 15, 107.1
See application file for complete search history.

(56) References Cited

U.S. PATENT DOCUMENTS 4,657,837 A 4/1987 Morita et al.
5,780,195 A 7/1998 Nava
6,166,169 A * 12/2000 Fritz et al. ..... 528/272
6,203,959 B1 * 3/2001 Tanikawa et al. ..... 430/108.8
6,432,600 B2 8/2002 Suwa et al. ..... 430/109.1
6,998,154 B2 * 2/2006 Barsotti et al. ..... 427/379
7,112,395 B2 * 9/2006 Ida et al. ..... 430/109.4
7,288,348 B2 * 10/2007 Hayami et al. ..... 430/45.1
2002/0150831 A1 * 10/2002 Ehara et al. ..... 430/126
2003/0109668 A1 * 6/2003 Kubo et al. ..... 528/274
2004/0175642 A1 * 9/2004 Ida et al. ..... 430/109.4
2004/0229142 A1 * 11/2004 Dojo et al. ..... 430/106.1

FOREIGN PATENT DOCUMENTS

EP 0640882 A1 3/1995
EP 1107069 A1 6/2001
JP 07-295293 11/1995
JP 08-15909 1/1996
JP 2003-202707 * 7/2003

OTHER PUBLICATIONS

Japanese Patent Office machine-assisted translation of JP 2003-202707 (pub. Jul. 2003).*
American Chemical Society (ACS) File Registry No. RN 301-10-0, entered STN on Nov. 16, 1984, copyright 2006 ACS on STN.*
USPTO English-language translation of JP 2003-202707 (pub. Jul. 2003).*

* cited by examiner

*Primary Examiner*—Janis L Dote
(74) *Attorney, Agent, or Firm*—Fitzpatrick, Cella, Harper & Scinto

(57) ABSTRACT

A color toner that comprises at least a binder resin, a colorant and a release agent, wherein the binder resin has at least a polyester unit and is synthesized in the presence of a tin compound as a catalyst represented by the general formula (1):

$$(RCOO)_2Sn \quad (1)$$

wherein, R is an alkyl group of 5 to 15 carbon atoms. The toner is excellent in charge build-up, resistance to high temperature offset, color reproducibility and transparency.

5 Claims, 2 Drawing Sheets

COLOR TONER

BACKGROUND OF THE INVENTION

1. Field of the Invention

The present invention relates to a toner for image forming methods such as electrophotography, electrostatic recording, electrostatic printing and toner jetting, in particular a color toner suitable for oil-less fixation.

2. Related Background Art

Recently, more compact, less weighted, more speedy and more reliable copiers and printers are required in view of space-saving and energy-saving points. As a result, the hardware has become comprised of simpler elements, and higher performance is required for the toner. In other words, without improvement in the toner performance, it is difficult to provide an excellent hardware. Particularly important color toner performance is color reproducibility.

Various methods are employed for full-color copiers and printers. One of the generally employed methods forms a full-color image by forming an electrostatic image on each of the photosensitive members, developing the images with a cyan, magenta, yellow and black toner, and feeding a transfer material between each photosensitive member and a transfer belt to transfer the images to the transfer material in a straight pass. Another method forms a full-color image by winding a transfer material on the transfer member facing the photosensitive member using electrostatic force or mechanical action such as a gripper and by conducting the development/transfer cycles four times.

It is required for these full-color image-forming toners, to be sufficiently mixed with each other before the image is fixed onto a transfer material with heat or pressure in the fixation step, without deteriorating color reproducibility or transparency of overhead projector (OHP) image.

Binder resins for toners include styrene-, polyester- and epoxy-based resin, and polyester resin is more preferable in view of sharp melting and low temperature fixation properties. Recently, use of a mixture of two or more polyester resins different in the softening point has been studied to expand the fixation region. Use of two or more resins will make uniform dispersion of the colorant during the hot melt-kneading step in the toner production more difficult.

Several attempts have been made to improve dispersion of a colorant to solve the above problems. Japanese Unexamined Patent Publication No. H8-15909 discloses preparation of a master batch containing a pigment kneaded beforehand into a binder resin at a high concentration, followed by dilution kneading of the master batch with the same binder resin and a charge-controlling agent or the like. Japanese Unexamined Patent Publication No. H7-295293 discloses an attempt to improve dispersion by using a specific combination of a pigment and a polyester resin.

These patent documents, however, are silent on a color toner containing a polyester binder resin synthesized in the presence of a specific polycondensation catalyst and also containing a release agent.

SUMMARY OF THE INVENTION

The inventors of the present invention have found, after an extensive study, that use of a binder resin having a polyester unit synthesized in the presence of a specific polycondensation catalyst can satisfy the above requirements, reaching the present invention. The above requirements can be satisfied by use of the toner described below.

The present invention provides a color toner containing at least a binder resin, a colorant and a release agent, wherein the binder resin has at least a polyester unit and is synthesized in the presence of a tin compound as a catalyst, represented by the general formula (1):

$$(RCOO)_2Sn \quad (1)$$

wherein, R is an alkyl group of 5 to 15 carbon atoms. The present invention can provide a toner excellent in fixability and resistance to high temperature offset, and excellent in color reproducibility such as a color mixing property and transparency due to the excellent dispersion of a colorant in the toner particles. Moreover, it is excellent in the charge build-up property to give high-quality images from the start.

DESCRIPTION OF THE PREFERRED EMBODIMENTS

Figure 1:
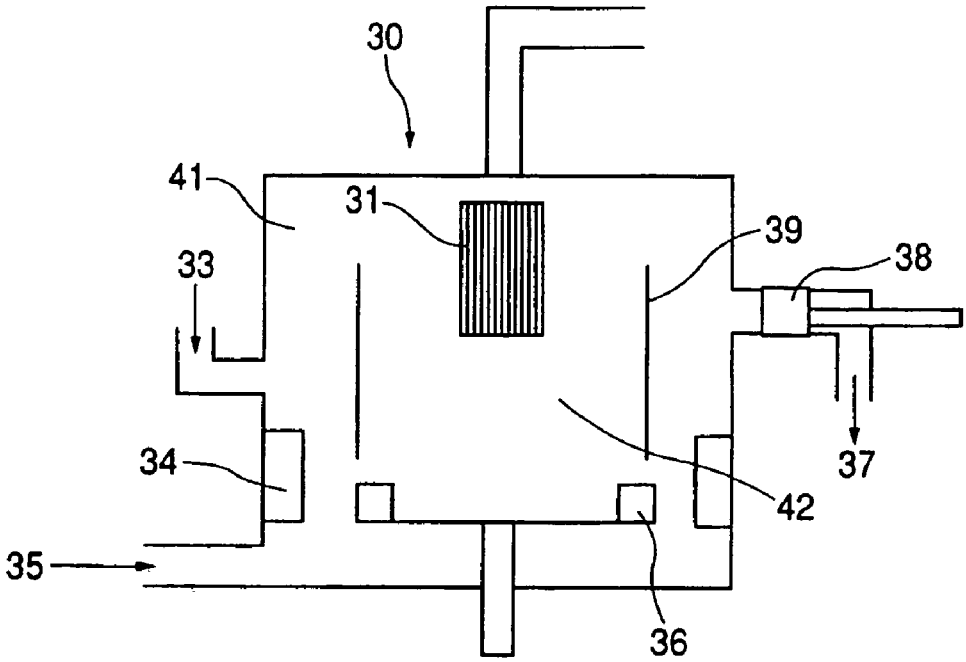
FIG. 1 illustrates a surface modification/treatment apparatus.

The binder resin for the present invention is synthesized in the presence of a tin compound as a catalyst, represented by the general formula (1):

$$(RCOO)_2Sn \quad (1)$$

wherein R is an alkyl group of 5 to 15 carbon atoms. This catalyst is suitable for esterification and transesterification, with which the resin softening point and other properties can be easily controlled. For example, it can decrease low-molecular-weight components with increased condensation time.

When the low-molecular-weight components are decreased, viscosity of the binder resin during the hot melt-kneading step is stabilized to facilitate uniform dispersion of the pigment therein. Moreover, the presence of this tin compound in the binder resin after polycondensation is considered to reduce agglomeration of the pigment particles in the hot melt-kneading step of toner production and enhance uniform dispersion in and adhesion to the polycondensed binder resin. Still more, use of the binder resin synthesized in the presence of the tin compound as a catalyst for the present invention stabilizes shear during the hot melt-kneading step, thereby facilitating fine dispersion of the release agent.

As the tin compound for the present invention, "R" is an alkyl group of 5 to 15 carbon atoms in the general formula (1) to provide the optimum catalytic effect for esterification.

The tin alkyl carboxylate is incorporated at 0.01 to 2 parts by weight, both inclusive, per 100 parts by weight of the binder resin, preferably 0.05 to 1 part. When less than 0.01 parts by weight, it may not fully exhibit its pigment dispersion improving effect while extending polyester polymerization time. When higher than 2 parts by weight, it may adversely affect charge properties of the toner, making the charges more sensitive to the environments.

Table 1 gives examples of the tin compounds, represented by the general formula (1), suitably used for the present invention.

TABLE 1

| | Designation | Chemical formula |
|---|---|---|
| Example compound (1) | Tin hexanoate | $[CH_3(CH_2)_4COO]_2Sn$ |
| Example compound (2) | Tin octanoate | $[CH_3(CH_2)_8COO]_2Sn$ |
| Example compound (3) | Tin 2-ethylhexanoate | $[CH_3(CH_2)_3CH(C_2H_5)COO]_2Sn$ |
| Example compound (4) | Tin decanoate | $[CH_3(CH_2)_8COO]_2Sn$ |
| Example compound (5) | Tin laurate | $[CH_3(CH_2)_{10}COO]_2Sn$ |

The binder resin for the toner of the present invention has a polyester unit, and is preferably selected from the group consisting of (a) polyester resin, (b) hybrid resin having a polyester unit and a vinyl polymer unit, (c) mixture of the hybrid resin and a vinyl polymer, (d) mixture of the hybrid resin and a polyester resin, (e) mixture of a polyester resin and a vinyl polymer, and (f) mixture of a polyester resin, the hybrid resin and vinyl polymer. It is preferable to incorporate the resin having a polyester unit in the binder resin at 30 wt % or more based on the whole binder resin, in order to realize the effect of the present invention.

(a) The starting monomers for the polyester resin include an alcohol of dihydric or more and carboxylic acid, carboxylic anhydride and carboxylic acid ester. More specifically, the dihydric alcohol component includes alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

The tri- or more hydric alcohol component includes sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

The acid component includes aromatic carboxylic acids such as phthalic, isophthalic, terephthalic, trimellitic and pyromellitic acid, and an anhydride thereof; alkyl dicarboxylic acids such as succinic, adipic, sebacic and azelaic acid, and an anhydride thereof; succinic acid substituted by an alkyl or alkenyl group of 6 to 12 carbon atoms, and an anhydride thereof; and unsaturated dicarboxylic acids such as fumaric, maleic and citraconic acid, and an anhydride thereof.

A preferable polyester resin is one produced by polycondensation of a bisphenol derivative represented by the general formula (2) as the diol component and a dibasic or higher carboxylic acid, anhydride thereof or lower alkyl ester thereof (such as fumaric, maleic, maleic anhydride, phthalic, terephthalic, trimellitic or pyromellitic acid) as the acid component, because of its capacity of giving good charge property to the color toner.

(2)

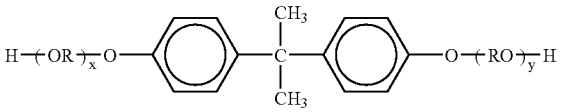

[wherein, R is ethylene or propylene group; "x" and "y" are each an integer of 1 or more, and "x+y" is 2 to 10 on the average].

(b) When a hybrid resin having a polyester unit and a vinyl polymer unit is used, still better wax dispersion and improved low temperature fixation and resistance to offset can be expected. The "hybrid resin component" for the present invention means a resin in which a vinyl polymer unit and a polyester unit are chemically bonded to each other. More specifically, it is composed of a polyester unit and a vinyl polymer unit bonded to each other by transesterification, where the latter unit is produced by polymerizing a monomer having a carboxylic acid ester group such as (meth)acrylic acid ester group. It is preferably of a graft (or block) copolymer with the vinyl polymer serving as the trunk unit and polyester unit as the branch unit.

In the present invention, the "polyester unit" means a segment derived from a polyester, and "vinyl polymer unit" means a segment derived from a vinyl polymer. The polyester-based monomer constituting the polyester unit is composed of a polybasic carboxylic acid component and polyhydric alcohol component, and the monomer component constituting the vinyl polymer unit has a vinyl group.

The vinyl monomers useful for producing the vinyl polymer unit or vinyl polymer for the present invention include: styrene and derivatives thereof such as styrene, o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; usaturated monoolefins such as ethylene, propylene, butylene and isobutylene; unsaturated polyenes such as butadiene and isoprene; halogenated vinyl compounds such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone, methylisopropenyl ketone; N-vinyl compounds such as N-vinyl pyrrole, N-vinyl carbazole, N-vinyl indole and N-vinyl pyrrolidone; vinyl naphthalenes; and acrylic and methacrylic acid derivatives such as acrylonitrile, methacrylonitrile and acryloamide.

Monomers having carboxylic group include unsaturated dibasic acids such as maleic, citraconic, itaconic, alkenyl succinic, fumaric and mesaconic acid; unsaturated dibasic acid anhydrides such as maleic, citraconic, itaconic, and alkenyl succinic anhydride; unsaturated dibasic acid half esters such as methyl maleate, ethyl maleate, butyl maleate, methyl citraconate, ethyl citraconate, butyl citraconate, methyl itaconate, methyl alkenyl succinate, methyl fumarate and methyl mesaconate half ester; unsaturated dibasic acid esters such as maleic acid dimethyl ester and fumaric acid dimethyl ester; α,β-unsaturated acids such as acrylic, methacrylic, crotonic and cinnamic acid; α,β-unsaturated acid anhydrides such as crotonic and cinnamic anhydride; anhydrides of the α,β-unsaturated acid and a lower fatty acid; alkenyl malonic, glutaric and adipic acid, anhydride thereof and monoester thereof.

Monomers having hydroxyl group useful for the invention include acrylic and methacrylic acid esters such as 2-hydroxyethyl acrylate, 2-hydroxyethyl methacrylate and 2-hydroxypropyl methacrylate; and 4-(1-hydroxy-1-methylbutyl) styrene and 4-(1-hydroxy-1-methylhexyl)styrene.

The vinyl polymer or vinyl polymer unit for the present invention may have a crosslinked structure with a crosslinking agent having two or more vinyl groups. The crosslinking agents useful for the present invention include aromatic divinyl compounds such as divinyl benzene and divinyl naphthalene; diacrylate compounds bonded by an alkyl chain such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate and the above compounds whose acrylate segment is replaced by methacrylate; diacrylate compounds bonded by an alkyl chain containing an ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and the above compounds whose acrylate segment is replaced by methacrylate; and diacrylate compounds bonded by a chain containing an aromatic group and ether bond such as polyoxyethylene(2)-2,2-bis(4-hydroxyphenyl)propane diacrylate, polyoxyethylene(4)-2,2-bis(4-hydroxyphenyl)propane diacrylate and the above compounds whose acrylate segment is replaced by methacrylate.

The multifunctional crosslinking agents useful for the present invention include pentaerythritol triacrylate, trimethylol ethane triacrylate, trimethylol propane triacrylate, tetramethylol methane tetraacrylate, oligoester acrylate and the above compounds whose acrylate segment is replaced by methacrylate; and triallyl cyanurate and triallyl trimellitate.

In the present invention, the vinyl polymer (or unit) and/or polyester resin (or unit) preferably contain a monomer component that is reactive with the component of the other resin. Such a monomer component that constitutes the polyester resin or unit and is reactive with the vinyl polymer or unit includes unsaturated dicarboxylic acids and an anhydride thereof such as phthalic, maleic, citraconic and itaconic acid. Such a monomer component that constitutes the vinyl polymer or unit and is reactive with the polyester resin or unit includes compounds having carboxyl or hydroxyl group, acrylic acid ester and methacrylic acid ester.

The reaction product of the vinyl polymer and the polyester resin is preferably obtained by polymerizing at least one of the polymer and resin in the presence of at least one of the resin and polymer containing a monomer component reactive with the other polymer or resin.

The polymerization initiators useful for production of the vinyl polymer or vinyl polymer unit for the present invention include ketone peroxides such as 2,2'-azobisisobutylonitrile, 2,2'-azobis(4-methoxy-2,4-dimethylvaleronitrile), 2,2'-azobis(2,4-dimethylvaleronitrile), 2,2'-azobis(2-methylbutylonitrile), dimethyl-2,2'-azobisisobutyrate, 1,1'-azobis(1-cyclohexanecarbonitrile), 2-(carbamoyleazo)-isobutylonitrile, 2,2'-azobis(2,4,4-trimethylpentane), 2-phenylazo-2,4-dimethyl-4-methoxyvaleronitrile, 2,2'-azobis(2-methyl-propane), methylethylketone peroxide, acetylacetone peroxide and cyclohexanone peroxide; and 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluylperoxiede, di-isopropylperoxy dicarbonate, di-2-ethylhexylperoxy dicarbonate, di-n-propylperoxy dicarbonate, di-2-ethoxyethylperoxy carbonate, di-methoxyisopropylperoxy dicarbonate, di(3-methyl-3-methoxybutyl)peroxy carbonate, acetylcyclohexylsulfonyl peroxide, t-butylperoxyacetate, t-butylperoxyisobutyrate, t-butylperoxyneodecanoate, t-butylperoxy-2-ethylhexanoate, t-butylperoxylaurate, t-butylperoxybenzoate, t-butylperoxyisopropyl carbonate, di-t-butylperoxyisophthalate, t-butylperoxyallyl carbonate, t-amylperoxy-2-ethylhexanoate, di-t-butylperoxyhexahydroterephthalate and di-t-butylperoxyazelate.

The hybrid resin for the full-color toner of the present invention may be produced by one of the methods (1) to (6) described below.

(1) The vinyl polymer and polyester resin are blended with each other, dissolved and swollen in an organic solvent (e.g., xylene), and then the solvent is distilled off. More specifically, to produce the hybrid resin composed of the polyester unit and vinyl polymer unit, separately produced polyester resin and vinyl polymer are dissolved and swollen in a small quantity of an organic solvent, and the blend is heated in the presence of an esterification catalyst and alcohol for the transesterification.

(2) Synthesis of the polyester resin is carried out in the presence of the vinyl polymer prepared beforehand, to produce the hybrid resin component composed of the polyester unit and vinyl polymer unit. The hybrid resin is produced by the reaction of the vinyl polymer (a vinyl monomer may be added as required) and the polyester monomer (alcohol and carboxylic acid) and/or polyester resin. An organic solvent may be used, as required, also in this case.

(3) Synthesis of the vinyl polymer is carried out in the presence of the polyester resin prepared beforehand, to produce the hybrid resin composed of the polyester unit and vinyl polymer unit. The hybrid resin is produced by the reaction of the polyester resin (a polyester monomer may be added as required) and the vinyl monomer and/or the vinyl polymer.

(4) The hybrid resin is produced by incorporating a vinyl monomer and/or polyester monomer (alcohol and carboxylic acid) in the vinyl polymer and polyester resin produced beforehand. An organic solvent may be used, as required, also in this case.

(5) After a hybrid resin composed of the polyester unit and vinyl polymer unit is produced, further addition and/or polycondensation reaction is carried out in the presence of a vinyl monomer and/or polyester monomer (alcohol and carboxylic acid) for production of the vinyl polymer and/or polyester resin, or further production of the hybrid resin. The hybrid resin in this case may be the one produced by one of the methods (2) to (4) described above, or may be another one produced by a known method, as required. Moreover, an organic solvent may be used, as required.

(6) A mixture of a vinyl monomer and polyester monomer (alcohol and carboxylic acid) is subjected to continuous addition and polycondensation reaction, to produce a mixture of the vinyl polymer, the polyester resin and the hybrid resin composed of the polyester unit and vinyl polymer unit. Moreover, an organic solvent may be used, as required.

In each of the methods (1) to (6) described above, two or more polymer units of different molecular weight and degree of crosslinking may be used for the vinyl polymer and/or polyester unit.

In the present invention, the vinyl polymer unit means the vinyl homopolymer, vinyl copolymer, vinyl homopolymer unit or vinyl copolymer unit.

The binder resin for the toner of the present invention may be a mixture of the polyester and vinyl copolymer, hybrid resin and vinyl polymer, or polyester resin, hybrid resin and vinyl polymer.

The binder resin component for the toner of the present invention has a molecular weight distribution determined by gel permeation chromatography (GPC), which has the main peak in a molecular weight range from 3,500 to 10,000, preferably 4,000 to 9,000, and preferably has an Mw/Mn ratio of 3.0 or more. When the binder resin has the main peak at a molecular weight less than 3,500, the toner may have insufficient resistance to hot offset. Also it is not desirable for the resin to have the main peak at a molecular weight above 10,000, because the toner may have insufficient low temperature fixation properties and give insufficient OHP transmittance. Moreover, it is difficult for the toner to exhibit good offset resistance, when the resin has an Mw/Mn smaller than 3.0.

The binder resin for the present invention preferably has a glass transition temperature (Tg) of 40 to 90° C. and softening temperature (Tm) of 80 to 150° C. to satisfy both storage stability of the toner, and colorant dispersion in the toner and fixation properties of the toner.

The binder resin for the present invention preferably has an acid value of not smaller than 2 mg-KOH/g and not higher than 50 mg-KOH/g. If the acid value is less than 2 mg-KOH/g, the polyester may not sufficiently exhibit its inherent superiority in negative charge property, and may have insufficient fixation properties and offset resistance. Above 50 mg-KOH/g, on the other hand, the resin may have insufficient resistance to moisture at high temperature and high humidity conditions, possibly causing problems such as fogging and toner scattering.

The toner of the present invention preferably has a light transmittance of 10 to 70% in a solution of 45% (v/v) methanol in water. As described later, measurement of light transmittance in an aqueous 45% (v/v) methanol (MeOH) solution is one of the most simple and accurate methods for determining quantity of a release agent in the vicinity of the toner surface. Measurement of light transmittance allows quantitative determination of a release agent in the vicinity of the toner surface for all of the toner particles. For the measurement, the toner particles are forcibly dispersed in a mixed solvent for a given time for full expression of the action of the release agent on the surface of the individual particles. Then the light transmittance is determined to give an accurate release agent quantity. When a release agent, which is hydrophobic, is present much on the toner particle surface, the toner particles dispersed in the solvent float up towards the liquid surface, to give a light transmittance as high as 70%. When the amount of the release agent on the surface is small, the particles are uniformly dispersed in the solvent to give a low light transmittance such as 10%, owing to the hydrophilic polyester unit in the binder resin.

The toner preferably has a light transmittance of 10 to 60%, more preferably 15 to 50%. If the transmittance is less than 10%, it is difficult for the toner to exhibit a high releasing effect during the fixation step, because of an insufficient quantity of the release agent on its surface. As a result, it has reduced fixation effect at low temperature, and hence energy-saving effect. Moreover, it needs a higher-pressure fixation means, which operates at a higher load. Above 70%, on the other hand, the toner has an excessive quantity of a release agent on the surface, which will cause such problems that the charging member is contaminated with the release agent, the toner fuses on the development sleeve resulting in high resistance of the sleeve, which may reduce efficiency of the actual development bias possibly leading to low image density.

When the binder resin synthesized in the presence of the catalyst of the present invention is used, shear during the melt-kneading step is stabilized and a release agent is dispersed more uniformly. Thus light transmittance is easily controlled in a range of 10 to 70%.

The toner of the present invention preferably has an average circularity of 0.922 to 0.955 for the particles having a circle-equivalent diameter of 3 μm or more, more preferably 0.925 to 0.945. The toner particles having an average circularity less than 0.922 may have an excessive contact area with each other and with the toner carrier, preventing toner release and transfer. On the other hand, those having an average circularity higher than 0.955 are so spherical that the residual toner after transfer tends to escape the cleaning blade resulting in poor cleaning.

When the binder resin synthesized in the presence of the tin compound of the present invention as a catalyst is used, shear during the melt-kneading step is stabilized, and the release agent is finely dispersed, and the toner particle circularity is improved while keeping light transmittance in a range of 10 to 70%.

Next described is a preferred method for controlling the light transmittance in an aqueous 45% methanol solution and the toner particle circularity to the above-described ranges. The inventors of the present invention have found that the toner particles having a desired circularity and well-dispersed release agent therein (e.g., having a desired light transmittance) can be produced by applying a mechanical impact to the particles during the toner production process while discharging the fine powder generated during the step. In other words, it is necessary to discharge the fine powder generated during the crushing step and/or the circularizing step in the toner production process. If not, the fine powder generated during the toner production process reaggolomerate each other to make the toner particles irregular in shape. As a result, an excessive mechanical impact force is needed to obtain the desired circularity for the toner particles, and excessive heat applied to the toner particles results in excess presence of the release agent on the particle surface.

Next, light transmittance determined in an aqueous 45% (v/v) methanol solution is described. Toner particles containing no release agent will have a light transmittance less than 10%, irrespective of their circularity, because a hydrophobic release agent is not present on the toner particle surface. The conventional toner particles containing a release agent, as with the toner of the present invention, can have a desired light transmittance in a range of 10 to 70%, when crushed by an air jet apparatus. However, they will have an insufficient average circularity of less than 0.922, out of the desired range for the present invention. These particles may be made spherical by using an appropriate system such as HYBRIDIZATION SYSTEM of Nara Machinery. This system, however, cannot remove the very fine powder produced during the crushing process, so that excessively high rotational speed or long residence time is required, and excessive heat is applied to the toner particles, which leads to the increased amount of the release agent on the surface more than 70%. Other systems that simultaneously crush and circularize the particles, such as a KRYPTRON SYSTEM by Kawasaki Heavy Industries and a SUPER ROTOR by Nisshin Engineering, are also difficult to remove the fine powder produced during the crushing process, giving an excessive heat to the toner particles and increasing the amount of the release agent on the surface to more than 70%.

The fine powder produced during the crushing process is one of the major causes for deterioration of the toner spent to the carrier when the toner is used in a two-component development. A system that applies a mechanical impact to the particles while discharging the fine powder can classify the particles without stopping the air stream by which the impact is applied. Therefore, it can efficiently discharge the fine powder out of the system without reagglomeration of the fine powder. The inventors of the present invention have found, based on the above results, that it is possible to control the desired toner particle shape, quantity of the fine powder produced and quantity of a release agent on the toner particle surface. The above-described problems can be solved by keeping circularity of the toner particles and quantity of a release agent on the particle surface well-balanced rather than merely making the particles spherical.

In other words, in the present invention, the average particle circularity is controlled in a range of 0.922 to 0.955 to improve toner release, and the quantity of the release agent on the particle surface is controlled, which is not achieved by the common toner production method, to prevent soiling of the charging part with the release agent. As a result, fluidity between the toner and the carrier is improved, and charge build-up property is also improved.

Next, the release agent for the present invention will be described.

Examples of the release agent useful for the present invention include aliphatic hydrocarbon-based waxes such as low-molecular-weight polyethylene, low-molecular-weight polypropylene, low-molecular-weight olefin copolymer, microcrystalline wax, Fischer-Tropsch wax and paraffin wax, oxides of aliphatic hydrocarbon-based waxes (e.g., oxide of polyethylene wax) and block copolymers thereof; waxes composed of an aliphatic ester as a major component such as ester waxes (e.g., behenyl behenate and stearyl stearate), carnauba wax and montanic acid ester wax; and waxes (e.g., carnauba wax) whose aliphatic ester is partly or totally deacidified. They also include saturated, linear fatty acids such as palmitic, stearic and montanic acid; unsaturated fatty acids such as brassidic, eleostearic and parinaric acid; saturated alcohols such as stearyl, aralkyl, behenyl, carnaubyl, seryl and melissyl alcohols; polyhydric alcohols such as sorbitol; fatty acid amides such as linoleic acid amide, oleic acid amide and lauric acid amide; saturated, fatty acid amides such as methylenebisstearic acid amide, ethylenebiscapric acid amide, ethylenebislauric acid amide and hexamethylenebisstearic acid amide; unsaturated, fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N'-distearylisophthalic acid amide; metallic salts of fatty acids (commonly referred to as metallic soaps) such as calcium stearate, calcium laurate, zinc stearate and magnesium stearate; aliphatic hydrocarbon-based waxes grafted with a vinyl monomer (e.g., styrene or acrylic acid); partial ester of a fatty acid and polyhydric alcohol such as behenic acid monoglyceride; and methyl ester compounds having hydroxyl group such as hydrogenated vegetable oil.

The toner of the present invention preferably contains at least one type of wax. Further, the toner of the present invention preferably has one or more endothermic peaks in a temperature range of 30 to 200° C. in the endothermic curve, determined by differential scanning calorimetry (DSC), the largest peak is present at 60 to 130° C., more preferably 65 to 110° C., in order to satisfy both the low temperature fixation and blocking resistance. Toners having the largest peak below 60° C. may have deteriorated blocking resistance. Toners having the largest peak above 130° C., on the other hand, may have poor fixation properties.

The release agent is incorporated at 0.5 to 10 parts, preferably 2 to 8 parts, per 100 parts by weight of the binder resin.

The colorant to be incorporated in the toner of the present invention is not limited, and may be selected from known pigments or dyes. The pigments useful for the present invention include magenta pigments such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 52, 53, 54, 55, 57, 58, 60, 63, 64, 68, 81, 83, 88, 90, 112, 122, 123, 163, 202, 206, 207 and 209, C.I. Pigment Violet 19, and C.I Vat Red 1, 2, 10, 13, 15, 23, 29 and 35.

These pigments may be used singly, but preferably used in combination with a dye to improve color clearness, in view of full-color image quality. Magenta dyes useful for the present invention include oil-soluble ones such as C.I. Solvent Red 1, 3, 8, 23, 24, 25, 27, 30, 49, 81, 82, 83, 84, 100, 109 and 121, C.I. Disperse Red 9, C.I. Solvent Violet 8, 13, 14, 21 and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39 and 40, and C.I. Basic Violet 1, 3, 7, 10, 14, 15, 21, 25, 26, 27 and 28.

Cyan pigments useful for the present invention include C.I. Pigment Blue 2, 3, 15, 16 and 17, C.I. Vat Blue 6, C.I. Acid Blue 45, and copper phthalocyanine pigment whose phthalocyanine skeleton is substituted by 1 to 5 phtalimidemethyl groups.

Yellow pigments useful for the present invention include C.I. Pigment Yellow 1, 2, 3, 4, 5, 6, 7, 10, 11, 12, 13, 14, 15, 16, 17, 23, 65, 73, 74, 83, 147, 155 and 180, and C.I. Vat Yellow 1, 3 and 20.

Black colorants useful for the present invention include carbon black, and the above-described yellow/magenta/cyan colorants adjusted to show a black color.

The colorant is preferably incorporated at 0.1 to 20 parts, more preferably 0.5 to 15 parts by weight per 100 parts by weight of the binder resin.

The toner particles can contain a charge-controlling agent, as required. The charge-controlling agent may be selected from known ones, for example, aromatic carboxylic acid derivatives and metallic salts thereof. Divalent or more valent metals are preferred for the metallic salts of aromatic carboxylic acid derivatives. The divalent metals include $Mg^{2+}$, $Ca^{2+}$, $Sr^{2+}$, $Pb^{2+}$, $Fe^{2+}$, $Co^{2+}$, $Ni^{2+}$, $Zn^{2+}$ and $Cu^{2+}$, of which $Zn^{2+}$, $Ca^{2+}$, $Mg^{2+}$ and $Sr^{2+}$ are more preferable. The trivalent and higher metals include $Al^{3+}$, $Cr^{3+}$, $Fe^{3+}$, $Ni^{3+}$, $Ti^{4+}$, $Zr^{4+}$ and $Si^{3+}$, of which $Al^{3+}$ and $Cr^{3+}$ are more preferable, and $Al^{3+}$ is particularly preferable. The particularly preferable charge-controlling agent for the present invention is an aluminum compound of 3,5-di-tert-butylsalicylic acid.

The charge-controlling agent is preferably incorporated at 0.1 to 10 wt % of the total toner weight, because the agent at this content can stabilize the charge amount of the toner particles at the initial stage and can secure the absolute charge amount necessary for development more easily to prevent deterioration of the image quality such as fogging and lower image density.

Further, the toner particles of the present invention preferably contains a flow improver to improve image quality and storage stability at high temperature. The preferable flow improvers for the present invention include finely powdered inorganic materials such as silica, titanium oxide and aluminum oxide. The finely powdered inorganic material is preferably hydrophobicized with a hydrophobicity-providing agent such as a silane compound, silicone oil or a mixture thereof.

The hydrophobicity-providing agents useful for the present invention include coupling agents such as a silane compound, and titanate-, aluminum- and zircoaluminate-based coupling agent.

More specifically, the silane compounds represented by the general formula $$Rm—Si—Yn$$

[wherein, R is an alkoxy group; "m" is an integer of 1 to 3; Y is an alkyl, vinyl, phenyl, methacryl, amino, epoxy, mercapto group or a derivative thereof; and "n" is an integer of 1 to 3] are preferable. These compounds include vinyl trimethoxysilane, vinyl triethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

It is incorporated preferably at 1 to 60 parts, more preferably 3 to 50 parts by weight, per 100 parts by weight of the fine inorganic powder.

The compounds particularly preferable for the present invention are alkyl alkoxysilane represented by the general formula (3):

$$C_nH_{2n+1}—Si—(OC_mH_{2m+1})_3 \quad (3)$$

wherein, "n" is an integer of 4 to 12; and "m" is an integer of 1 to 3. Compounds having an "n" value less than 4 tend to have an insufficient hydrophobicity-providing property, although the treatment is simplified. On the other hand, compounds having an "n" value higher than 12 tend to have low flow improving effect because it accelerates agglomeration of the fine inorganic particles with each other, although the hydrophobicity-providing property is sufficient. The hydrophobicity-providing treatment may not be carried out well with the alkyl alkoxysilane coupling agent having an "m" value higher than 3, because of its insufficient reactivity. More preferably, the alkyl alkoxysilane coupling agent has an "n" value of 4 to 8, and "m" value of 1 to 2.

The treating amount of the alkyl alkoxysilane coupling agent is preferably 1 to 60 parts, more preferably 3 to 50 parts by weight, per 100 parts by weight of the fine inorganic powder.

The hydrophobicity-providing treatment may be carried out in the presence of one or more hydrophobicity-providing agents. More specifically, it may be carried out in the presence of a hydrophobicity-providing agent, or two or more agents either simultaneously or consecutively.

The flow improver is added preferably at 0.01 to 5 parts by weight, more preferably 0.05 to 3 parts, per 100 parts by weight of the toner particles.

The toner of the present invention is applicable to a one- and two-component developer. When it is applied to a two-component developer, although not limited thereto, the usable carrier is a metal such as iron, nickel, copper, zinc, cobalt, manganese, chromium, rare-earth metals, an alloy or oxide thereof, or ferrite, which may be surface-oxidized or not.

In particular, three-element magnetic ferrite particles of Mn—Mg—Fe, composed of manganese, magnesium and iron as the major components, are preferable for the carrier particles. The magnetic carrier particles are preferably coated with a resin. The coating resins useful for the present invention include silicone resin, polyester resin, styrene-based resin, acrylic resin, polyamide, polyvinyl butyral and aminoacrylate resin, of which silicone resin is more preferable. The particularly preferable silicone resins are the one containing nitrogen and the other one modified with a nitrogen-containing silane coupling agent, in consideration of their capacity of giving negative, triboelectric charge, environmental stability and prevention of carrier surface soiling.

The carrier particles may be coated by a known method. For example, the magnetic carrier core particle surfaces may be coated with a coating solution of a resin or the like dissolved or suspended in a solvent, or the magnetic carrier core particles may be mixed with powdered resin.

The magnetic carrier preferably has an average particle diameter of 15 to 60 μm, more preferably 25 to 50 μm, in relation to the weight-average particle diameter of the toner. The magnetic particles can have a desired average particle diameter in the above range and a certain diameter distribution by sieve classification etc. For precise classification, it is preferable to repeat two or more times sieving using an appropriate mesh sieve. Controlling the mesh opening shape by plating or the like is an effective procedure.

When the two-component Developer is prepared, the toner content is 2 to 15 wt %, preferably 4 to 13 wt %, of the developer, to obtain a good result. When the toner content is less than 2%, the image density may become insufficient, and when the toner content is higher than 15%, problems such as fogging and scattering may occur.

Next, the toner production procedure will be described.

First, in the starting material mixing step, at least the resin and colorant to be incorporated in the toner are weighed and mixed. The mixing systems useful for the present invention include a double cone mixer, V-shaped mixer, drum-shaped mixer, SUPERMIXER, HENSCHEL mixer and NAUTA mixer. The starting mixture prepared above is then treated by melt-kneading to melt the incorporated resin, in which a colorant etc. is dispersed. The melt-kneading step may be carried out batchwise or continuously using a pressure kneader, BANBURY mixer or the like. Recently, a single- or twin-screw extruder is a standard choice for its capacity of continuous production. These machines include a KTK model twin-screw extruder (Kobe Steel), TEM model twin-screw extruder (Toshiba Machine), twin-screw extruder (KCK) and cokneader (Buss). The colored resin composition prepared by melt-kneading the starting toner mixture is rolled by using a suitable system such as the 2-roll system, and cooled with water or the like.

The colored resin composition is generally crushed to a desired particle diameter, after being cooled. In the crushing step, it is coarsely crushed by a crusher, hammer mill, feather mill or the like, and then crushed more finely by a suitable system such as KRYPTRON SYSTEM (Kawasaki Heavy Industries) or SUPER ROTOR (Nisshin Engineering). It may be classified, as required, by a sieving system such as ELBOW JET (Nittetsu Mining) or TURBOPLEX (Hosokawa Micron), the former being based on inertial classification and the latter on centrifugal classification, to produce the particles having a weight-average diameter of 3 to 11 μm.

The classified particles may be further treated in a surface-modification step for surface modification (i.e., for making them spherical) by an adequate system such as a hYBRIDIZATION SYSTEM (Nara Machinery) or MECHANOFUSION system (Hosokawa Micron).

Figure 2:
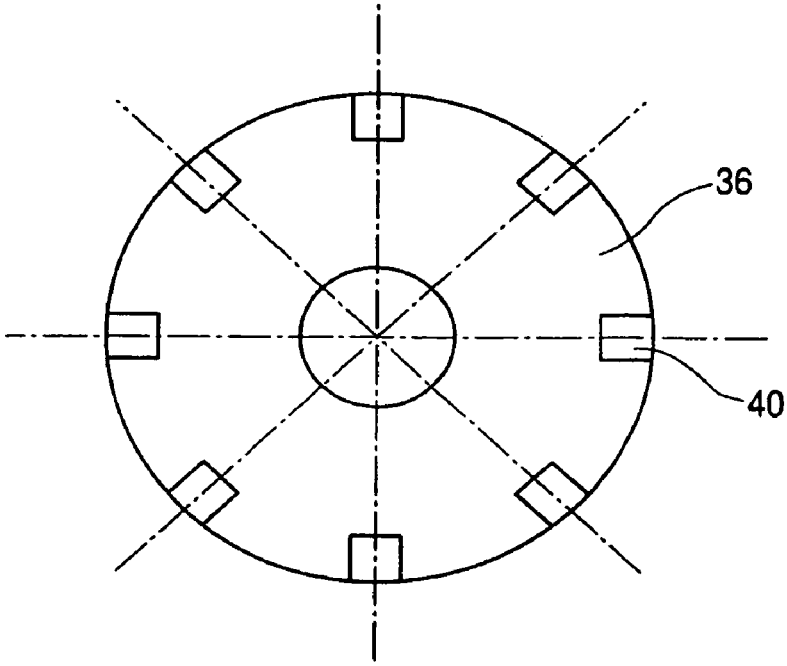
FIG. 2 presents a partly magnified apparatus shown in FIG. 1.

For the present invention, it is preferable to produce the classified particles having a weight-average diameter of 3 to 11 μm by a system which simultaneously performs classification and surface modification by mechanical impact, shown in FIG. 1 or 2, after being crushed by an air-jet crusher rather than mechanical crusher. If necessary, the particles may be classified by an aero-sieve system such as HI-BOLTER (Shin Tokyo Kikai). Then additives may be added to the classified toner particles by using a high-speed mixer such as HENSCHEL mixer, SUPER MIXER or the like, where a given quantity of the additive is stirred and mixed with the toner particles under a high shear stress.

The apparatuses suitably used for the present invention will be described in more detail. The surface modification apparatus, shown in FIGS. 1 and 2, comprises the casing 30; jacket (not shown) for passing cooling water or an antifreeze solution; dispersion rotor 36 as a surface modification means, which is a disk-shaped rotating body, encased in the casing 30, attached to a central rotating shaft, having a plurality of angular disks or cylindrical pins 40 on the upper side, and capable of rotating at a high speed; liner 34 positioned at a certain distance from the outer periphery of the dispersion rotor 36 and provided on the surface with a number of grooves arranged at constant intervals (the grooves are not essential); classification rotor 31 as a means for classifying the surface-modified starting composition to a given diameter; cooling air inlet port 35 through which cooling air is introduced into the system; starting composition inlet port 33 through which the starting composition is introduced to be treated; discharge valve 38 which can be opened or closed to optionally control surface modification time; powder discharge port 37 through which the treated powder is discharged out of the system; and cylindrical guide ring 39 as a guiding means, which divides the space between the classification rotor 31 as a classification means and dispersion rotor 36 as a surface modification means/liner 34 into the first space 41 through which the starting composition is sent to the classification means and second space 42 through which the particles classified to eliminate the fine powder are sent to the surface modification means. The gap between the dispersion rotor 36 and liner 34 is the surface modification zone, and the classification rotor 4 and its periphery provides the classification zone.

The surface modification apparatus of the above structure receives the finely crushed particles from the starting composition inlet port 33 while the discharge valve 38 is kept closed. These particles are induced by a blower (not shown) to be classified by the classification rotor 31, which continuously discharges the fine powder having a diameter smaller than a given level out of the system. The classified coarse particles having a diameter of a given level or more are directed to the surface modification zone under a centrifugal force, carried by a circulating flow generated by the dispersion rotor 36 along the inner periphery of the guide ring 39 (through the second space 42). The particles are surface-modified in the surface modification zone under a mechanical impact between the dispersion rotor 36 and liner 34. The surface-modified particles are carried along the outer periphery of the guide ring 39 (first space 41) by a flow of cold air passing through the system to the classification zone. The fine powder classified in this zone is discharged out of the system by the classification rotor 4 and the coarse particles are carried by a circulating flow to return back to the surface modification zone, where they are surface-modified again. After a lapse of a given time, the discharge valve 38 is opened to discharge the surface-modified particles through the discharge port 37.

The inventors of the present invention have found out that time before the discharge valve is opened (cycle time) and rotational speed of the dispersion rotor are important parameters for controlling circularity of the particles and quantity of a release agent on the particle surface. Increasing cycle time or circumferential speed of the dispersion rotor effectively increases circularity of the particles. Conversely, decreasing cycle time or circumferential speed of the dispersion rotor effectively controls quantity of a release agent on the particle surface at a low level. Of these parameters, circumferential speed of the dispersion rotor should be increased to a certain level to make the particles spherical effectively. Therefore, increasing cycle time is necessary to effectively make the particles spherical, which increases the amount of the release agent on the particle surface too much. The effective circumferential speed is $1.2\times10^5$ mm/second or more and effective cycle time is 15 to 60 seconds.

Next, the analytical procedures used for the present invention will be described.

1) Light Transmittance in an Aqueous 45% (v/v) Methanol Solution

1. Preparation of the Toner Dispersion Solution

Prepare a 45:55 by volume aqueous solution of methanol and water. Put 10 mL of the aqueous solution in a 30 mL sample bottle (Nichiden-Rika Glass, SV-30), put 20 mg of the toner on the liquid surface, and cover the bottle with the lid. Shake the bottle using a shaker (Yayoi, YS-LD) for 5 seconds at $150S^{-1}$, where the shaking strut moves at an angle of 15° forward and 20° backward (0°: upright position). Set the sample bottle on a holder attached to the strut tip in such a way as to fix the sample bottle lid in the extension of the strut centerline. Analyze the sample 30 seconds after removal of the sample bottle from the shaker.

2. Measurement of Light Transmittance

Put the dispersion solution prepared above in a 1 cm square quartz cell, and measure light transmittance B (%) (refer to the following formula) at a wavelength of 600 nm by a spectrophotometer (Shimadzu, MPS2000) after 10 minute standing.

Light transmittance B(%)=I/I0×100 (I: incident light beam, I0: transmitted light beam)

2) Evaluation of Charge Stability

Figure 3:
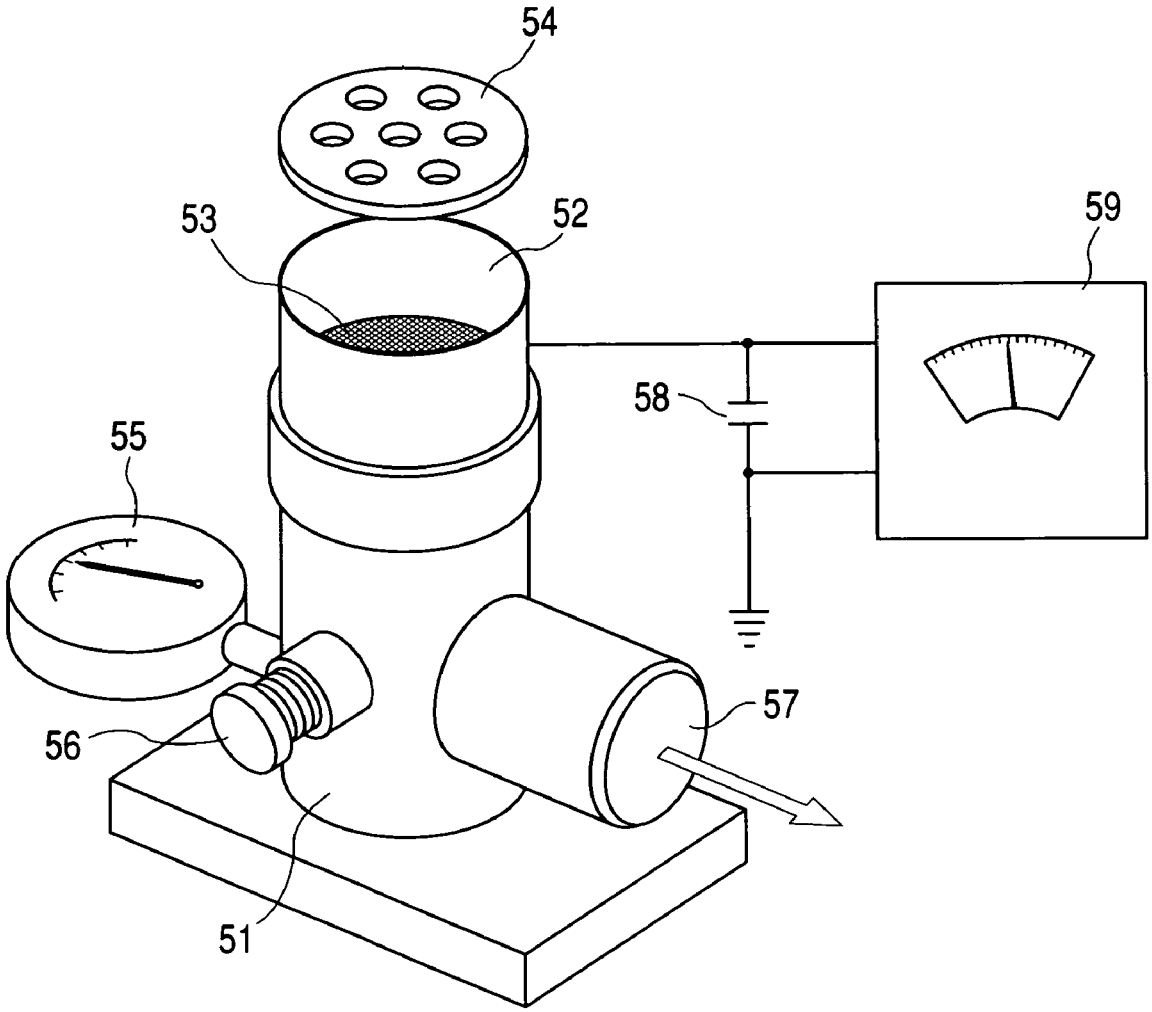
FIG. 3 illustrates an apparatus for measuring the triboelectric charge amount.

FIG. 3 outlines a triboelectric charge analyzer, that comprises the metallic measurement container 52 provided with the screen 53 at the bottom, the screen 53 having 30 μm openings (500 meshes). Put about 0.5 to 1.5 g of the two-component Developer, collected from a development sleeve in a copier or printer, and put the lid 54 on the container 52. Weigh the whole measurement container 52 (W1 (g)). Keep the container inside at a vacuum of 250 mmAq (measured by the vacuum meter 55) by aspirating air through the suction port 57 by the suction unit 51 (coated with an insulator at least for the portion coming into contact with the measurement container 52) while air stream is controlled by the control valve 56. Keep the vacuum for a sufficient time, preferably for 2 minutes, to remove the toner by aspiration. Read voltage (V) on the potentiometer 59, where the condenser 58 has a capacitance of C (mF). Weigh the whole measurement container 52 after the aspiration (W2 (g)). The triboelectric charge (mC/kg) is given by the following formula.

$$\text{Triboelectric charge of the sample (mC/kg)} = C\times V/(W1-W2)$$

(measurement conditions are temperature: 23° C., and humidity: 50 to 60% RH)

3) Measurement of the Maximum Endothermic Peak of the Release Agent and Toner

Temperature curve:

Heating I (30 to 200° C., heated at 10° C./minute)

Cooling I (200 to 30° C., cooled at 10° C./minute)

Heating II (30 to 200° C., heated at 10° C./minute)

The maximum endothermic peak of the toner is determined by a differential scanning calorimeter (DSC), DSC-7 (Perkin Elmer) or DSC2920 (TA Instruments, Japan) in accordance with ASTM D-3418-82.

Accurately weigh 5 to 20 mg (preferably 10 mg) of the sample, put it in an aluminum pan to be analyzed. An empty pan is also used as the reference. Establish the temperature curve in a temperature range of 30 to 200° C., heated at 10° C./minute by the measurement carried out at normal temperature and humidity. The maximum endothermic peak of the toner of the present invention is defined as the highest peak from the base line in the heating zone II after the endothermic peak Tg of the resin occurs.

Otherwise, when the endothermic peak Tg of the resin overlaps another peak and cannot be clearly distinguished, it is defined as the highest peak among the overlapped peaks.

4) Toner Particle Circularity

Average circularity of the toner particles of the present invention is used as a simple measure for quantitatively representing the particle shape. The particles are analyzed by a flow type particle image analyzer (SYSMEX, FPIA-2100) to determine circularity of the individual particles measured by the following formula (1), and average circularity is determined by dividing sum of circularity by total number of the particles (see the formula (2)).

$$\text{Circularity } \text{“}a\text{”} = L_0/L \tag{1}$$

[wherein, $L_0$ is peripheral length of a circle having the same projected area as that of the particle image, and L is peripheral length of the particle image, produced by image processing at a resolution of 512 by 512 pixels, 0.3 by 0.3 μm.

$$\text{Average circularity } \bar{a} = \sum_{i=1}^{m} a_i / m \tag{2}$$

The standard deviation SD of circularity is given by the formula (3):

$$\text{Standard deviation } SD \text{ of circularity} = \sum_{i=1}^{m} (\bar{a} - a_i)^2 / m^{1/2} \tag{3}$$

[wherein, $\bar{a}$ is average circularity given by the formula (2), $a_i$ is circularity of each particle given by the formula (1), and "m" is the number of the particles analyzed.

Circularity used for the present invention is an index for toner particle irregularity. It is 1.00 when the particle is perfectly spherical, and decreases as the particle surface shape becomes more complex. The standard deviation SD used for the present invention is an index of circularity scattering; the smaller the number, the smaller the variation of the toner shape.

The analyzer "FPIA-2100" used for the present invention determines circularity of the individual particles, and then average circularity and standard deviation of circularity, where the particles having a circularity of 0.4 to 1.0 are divided into 61 classes to estimate average circularity and standard deviation of circularity based on the median and frequency in each class. The average circularity and standard deviation estimated by the analyzer are very close to those directly given by the above formulae with circularity of the individual particles, the difference being essentially negligible. Therefore, the above-described partly modified procedure based on the above concept for directly estimating these values with circularity of the individual particles may be used for the present invention for simplifying the data processing works. The analyzer "FPIA-2100" can determine particle shapes more accurately than "FPIA-1000," which has been used for toner particle shapes, because of several improvements; thinner layer of sheath flow (from 7 to 4 μm), improved magnification of the processed particles and improved image processing resolution (from 256 by 256 to 512 by 512) of the particles collected. Therefore, it can collect the fine powder more securely. FPIA-2100, giving more accurate shape information, is more useful for the present invention, which needs more accurate analysis of the particle shapes.

More specifically, these values are determined by the following procedure. Ion-exchanged water (10 mL), treated beforehand to remove solid impurities or the like, is put in a container, to which a surfactant as a dispersant (preferably alkyl benzene sulfonate) is added, and then 0.02 g of the sample is added and uniformly dispersed by an ultrasonic dispersing machine (Nikkaki-Bios, TETORA 150) for 2 minutes, to prepare the dispersion solution to be analyzed. The system is cooled, as required, to prevent dispersion solution temperature from increasing to 40° C. or higher.

The flow type particle image analyzer described above is used to determine color toner particle shapes, where the dispersion solution is readjusted to have a color toner particle concentration of 3,000 to 10,000/μL, and at least 1,000 color toner particles are counted. The data are processed to determine average circularity of the color toner particles, after the particles of 3 μm or less in diameter are removed.

5) Molecular Weight Distribution Determined by GPC

Molecular weight of the binder resin is determined by gel permeation chromatography (GPC) by the following procedure.

The column is stabilized in a heat chamber kept at 40° C., through which tetrahydrofuran (THF) as a solvent is passed at 1 mL/minute. About 50 to 200 μL of a solution of the binder resin in THF, adjusted at a concentration of 0.05 to 0.6 wt %, is injected into the column kept at the above temperature for analysis. Molecular weight of the sample is determined by a calibration curve plotting logarithmic molecular weight distributions of several standard samples of monodisperse polystyrene against count number (retention time). The calibration curve can be prepared adequately by using at least 10 standard polystyrene samples such as those supplied by TOSOH or Pressure Chemical Co., having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. A detector is a refractive index (RI) detector.

Use of a combination of two or more commercial polystyrene gel columns is recommended to accurately measure a molecular weight in a range of $10^3$ to $2\times10^6$. The examples of the combinations include SHODEX GPC KF-801, 802, 803, 804, 805, 806 and 807 (Showa Denko), and μ-STYRAGEL 500, 103, 104 and 105 (Waters).

6) Measurement of Acid Value

Acid value is determined basically in accordance with JIS K-0070.

(1) Accurately weigh 0.5 to 2.0 g of the coarsely crushed sample (W(g)).

(2) Put the sample in a 300 mL beaker, to which add 150 mL of a 4/1 mixture of toluene and ethanol to prepare the solution.

(3) Potentiometrically titrate the solution with a 0.1 mol/L ethanol solution of KOH. The titration can be done automatically by a combination of a potentiometric titration analyzer (such as Kyoto Electronics Manufacturing's AT-400 (win workstation)) and electrically driven burette ABP-410.

(4) Conduct the blank test. Quantity of the KOH solution used: S (mL) in the titration, and B (mL) in the blank test.

(5) Determine acid value by the following formula, where "f" is a factor of the KOH solution.

$$\text{Acid value (mg-KOH/g)}=\{(S-B)\times f\times 5.61\}/W$$

7) Measurement of Glass Transition Temperature of Resin

Glass transition temperature (Tg) of the resin is determined in accordance with ASTM D3418-82 using a differential scanning calorimeter (DSC) or DCS-7 (Perkin Elmer).

Accurately weigh 5 to 20 mg (preferably 10 mg) of the sample, put it in an aluminum pan to be analyzed. An empty pan is also used as the reference. Heat the sample at 10° C./minute in a temperature range of 30 to 200° C. Conduct the measurement at normal temperature and humidity. Change in the specific heat occurs while the sample is heated in a range from 40 to 100° C. The point at which the line between the midpoints of the base line before and after the specific heat change intersects with the DSC curve is defined as the glass transition temperature (Tg) of the resin for the present invention.

8) Measurement of Softening Point of Resin

Softening temperature is determined in accordance with JIS K-7210 using a KOKA type flow tester. More specifically, extrude 1 $cm^3$ of the sample through a nozzle (diameter: 1 mm, length: 1 mm) under a load of 1960 $N/m^2$ (20 $kg/cm^2$), applied by a plunger, in a KOKA type flow tester (Shimadzu) while it is heated at 6° C./minute. Draw a downward travel of the plunger (flow value)—temperature curve. The temperature corresponding to h/2 is defined as the softening temperature Tm of resin, where "h" is height of the S-shaped curve. This temperature is the level at which half of the resin is flown out.

9) Measurement of Toner Particle Diameter Distribution

The toner average particle diameter and diameter distribution are determined by a COULTER counter TA-II model (Coulter). However, a COULTER multisizer (Coulter) may be also used. The electrolytic solution is a 1% aqueous solution of NaCl (first grade sodium chloride). For example, an ISOTON R-II model (Coulter Scientific, Japan) can be used. For measurement of particle diameter distribution, 100 to 150 mL of the aqueous electrolytic solution described above is incorporated with 0.1 to 5 mL of a surfactant as a dispersant, preferably an alkyl benzene sulfonate, and 2 to 20 mg of the sample. The electrolytic solution suspending the sample is treated by a ultrasonic dispersing machine for about 1 to 3 minutes, and analyzed to measure the volume and number of the toner particles having a diameter of 2.00 μm or more by the above-described analyzer using 100 μm apertures, from which the volume and number distributions are determined. Then, weight-average particle diameter (D4) (median in each channel is taken as a representative value for that channel) is determined, based on these distributions of the toner particles of the present invention.

A total of 13 channels are used; 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm and 32.00 to 40.30 μm.

EXAMPLES

The present invention will be described in detail by EXAMPLES, which by no means limit the present invention.

Resin Production Example 1, Production of Resin Having a Polyester Unit

A mixture of 1.9 moles of styrene, 0.21 moles of 2-ethylhexyl acrylate, 0.15 moles of fumaric acid, 0.03 moles of α-methylstyrene dimer and 0.05 moles of dicumyl peroxide was put in a funnel as a starting material of the vinyl copolymer. Another mixture of 7.0 moles of polyoxypropylene(2.2)-2,2-bis(4-hydroxyphenyl)propane, 3.0 moles of polyoxyethylene(2.2)-2,2-bis(4-hydroxyphenyl)propane, 3.0 moles of terephthalic acid, 2.0 moles of trimellitic anhydride, 5.0 moles of fumaric acid and 0.2 g of tin 2-ethylhexanoate was put in a 4 liter, 4-necked glass flask. The flask, equipped with a thermometer, stirring rod, condenser and nitrogen-introducing tube, was put in a mantle heater. The flask was purged with nitrogen and slowly heated with stirring to 145° C., to which the above-described mixture of the monomer for vinyl resin, crosslinking agent and polymerization initiator was added dropwise from the funnel over 4 hours with stirring. Then, the mixture was heated to 200° C., and the above components were reacted for 4 hours, to prepare Binder Resin 1 having a polyester unit. The content of the polyester unit was 90 wt % Its properties are given in Table 2.

Resin Production Examples 2 to 5, Production of Resins Having a Polyester Unit Binder Resins 2 to 5, shown in Table 2, were prepared in the same manner as in RESIN PRODUCTION EXAMPLE 1, except that quantities and types of monomers and tin compounds of alkyl carboxylic acid were changed as shown in Table 2. Their properties are given in Table 2.

Resin Production Example 7, Production of Resin Having a Polyester Unit

Binder Resin 7, shown in Table 2, was prepared in the same manner as in RESIN PRODUCTION EXAMPLE 1, except that quantities and types of monomers and tin compound of alkyl carboxylic acid were changed as shown in Table 2. Its properties are given in Table 2.

Resin Production Examples 8 to 10, Production of Comparative Resins Having a Polyester Unit Binder Resins 8 to 10, shown in Table 2, were prepared in the same manner as in RESIN PRODUCTION EXAMPLE 1, except that quantities and types of tin compounds of alkyl carboxylic acid were changed as shown in Table 2. Their properties are given in Table 2.

TABLE 2

| | Resin composition | | | | | | Resin properties | | | | | |
|---|---|---|---|---|---|---|---|---|---|---|---|---|
| | Polyester monomer* | | Monomer for vinyl polymer* | | Tin compound of alkyl carboxylic acid | | | Molecular weight analysis results | | | | |
| | Monomer type | Content in the binder resin (wt %) | Monomer type | Content in the binder resin (wt %) | Type | Addition (parts per 100 parts of the resin by weight) | Softening point Tm (° C.) | Mw ($\times 10^3$) | Mn ($\times 10^3$) | Mw/Mn | Tg (° C.) | Acid value AV (mg-KOH/g) |
| Binder Resin 1 | PO-BPA, EO-BPA TFA, FA, TMA | 90 | St, 2-EHA, FA α-Methyl-St | 10 | Tin 2-ethylhexanoate $(C_7H_{15}COO)_2Sn$ | 0.5 | 116 | 100 | 3.9 | 25.6 | 63 | 27 |
| Binder Resin 2 | PO-BPA, EO-BPA TFA, FA, TMA | 90 | St, 2-EHA, FA α-Methyl-St | 10 | Tin 2-ethylhexanoate $(C_7H_{15}COO)_2Sn$ | 0.08 | 109 | 89 | 3.2 | 27.8 | 62 | 30 |
| Binder Resin 3 | PO-BPA, EO-BPA TFA, FA, TMA | 90 | St, 2-EHA, FA α-Methyl-St | 10 | Tin 2-ethylhexanoate $(C_7H_{15}COO)_2Sn$ | 1.2 | 128 | 125 | 4.2 | 29.8 | 64 | 26 |
| Binder Resin 4 | PO-BPA, EO-BPA TFA, FA, TMA | 100 | — | — | Tin 2-ethylhexanoate $(C_7H_{15}COO)_2Sn$ | 0.5 | 118 | 33 | 3.2 | 10.3 | 58 | 18 |
| Binder Resin 5 | PO-BPA, EO-BPA TFA, FA, TMA | 100 | — | — | Tin 2-ethylhexanoate $(C_7H_{15}COO)_2Sn$ | 0.08 | 95 | 15 | 2.0 | 7.5 | 52 | 15 |
| Binder Resin 7 | PO-BPA, EO-BPA TFA, FA, TMA | 80 | St, 2-EHA, FA α-Methyl-St | 20 | Tin laurate $(C_{11}H_{23}COO)_2Sn$ | 0.8 | 110 | 87 | 3.5 | 24.9 | 61 | 28 |
| Binder Resin 8 | PO-BPA, EO-BPA TFA, FA, TMA | 90 | St, 2-EHA, FA α-Methyl-St | 10 | Tin propionate $(C_2H_5COO)_2Sn$ | 0.5 | 115 | 240 | 3.9 | 61.5 | 68 | 26 |
| Binder Resin 9 | PO-BPA, EO-BPA TFA, FA, TMA | 90 | St, 2-EHA, FA α-Methyl-St | 10 | Tin stearate $(C_{17}H_{35}COO)_2Sn$ | 0.08 | 107 | 255 | 3.2 | 79.7 | 69 | 25 |
| Binder Resin 10 | PO-BPA, EO-BPA TFA, FA, TMA | 90 | St, 2-EHA, FA α-Methyl-St | 10 | Dioctyl tin oxide | 0.3 | 120 | 295 | 4.2 | 70.2 | 66 | 28 |

*TPA: Terephthalic acid, DSA: dodecenylsuccinic anhydride, FA: Fumaric acid, TMA: Trimellitic acid, PO-BPA: Bisphenol A/propylene oxide adduct, EO-BPA: Bisphenol A/ethylene oxide adduct, St: Styrene, 2-EHA: 2-ethylhexyl acrylate The waxes used for the present invention are summarized in Table 3

TABLE 3

| | Wax type | Melting point |
|---|---|---|
| Wax (A) | Refined normal paraffin | 74.3° C. |
| Wax (B) | Refined normal paraffin | 63.0° C. |
| Wax (C) | Polyethylene with alcohol at both ends | 111.3° C. |

Example 1

Cyan Toner 1 was prepared by the following procedure.

| (First kneading step) | |
|---|---|
| Binder Resin (1) having a polyester unit | 70 parts by weight |
| First pigment paste | 100 parts by weight |

Here the first pigment paste was prepared from a pigment slurry containing C.I. Pigment Blue 15:3 by removing some water to the solid content of 30 wt % (water content: 70%), but never subjected to drying treatment.

The starting mixture of the above composition was put in a kneader type mixer, where it was mixed and heated without applying pressure. When it reached a maximum temperature (determined solely by boiling point of the solvent in the paste, 90 to 100° C. in this case), the pigment in the aqueous phase was distributed or moved into the molten resin phase. The mixture was treated for melt-kneading under heating for another 30 minutes after confirming the above phenomenon, to sufficiently transfer the pigment from the paste. Then, the mixer was stopped temporarily to discharge hot water, and then the mixture was heated to 130° C., at which it was treated again for melt-kneading for about 30 minutes, to disperse the pigment and, at the same time, distill off water. On completion of the treatment, the kneaded product (First Kneaded Product) was cooled and withdrawn from the machine. It contained water at around 0.5 wt %.

| (Second kneading step) | |
|---|---|
| First Kneaded Product (containing the pigment at 30%) | 10.0 parts by weight |
| Binder Resin (1) having a polyester unit | 100.0 parts by weight |
| Wax (A) | 5.0 parts by weight |
| Aluminum compound of 3,5-di-tert-butylsalicylic acid (charge-controlling agent) | 1.0 part by weight |

The above composition was sufficiently mixed by a Henschel mixer for preliminary mixing, and treated for melt-kneading by using a twin-screw extruder set at 100° C. The cooled kneaded composition was coarsely crushed by using a hammer mill to around 1 to 2 mm, and then more finely crushed by using an air-jet fine crusher to 20 μm or less. The resulting particles were classified and circularized by an apparatus that carried out simultaneously classification and surface modification of the particles with the aid of a mechanical impact, to prepare the classified cyan resin particles having a weight-average diameter of 7.2 μm, determined from the volume-based particle diameter distribution.

To 100 parts of the cyan resin particles, 1.5 parts of titanium oxide that had been surface-treated with isobutyltrimethoxysilane and had a primary particle diameter of 50 nm were added to prepare Cyan Toner 1. Then to the Cyan Toner 1, magnetic ferrite carrier (average particle diameter: 45 μm) coated with silicone resin was added to prepare two-component Cyan Developer 1 containing the toner at 7%.

[Evaluation of Charge Build-up Properties]

Cyan Developer 1 was tested by a development apparatus of a color copier (Canon, CLC-1000) operating at a sleeve circumferential speed at 200 mm/second under no load for 10, 30, 60, 120, 300 and 600 seconds. The triboelectric charge on the sleeve was evaluated according to the following standards. The evaluation results are given in Table 4.

(Evaluation Standards)

A: The triboelectric charge comes in saturation within 30 seconds.

B: The triboelectric charge comes in saturation within 60 seconds.

C: The triboelectric charge comes in saturation within 120 seconds.

D: The triboelectric charge does not come in saturation even after 600 seconds.

[Evaluation of OHP Transparency]

Light transmittance of the OHP films was analyzed by a self-recording spectrophotometer (Shimadzu, UV2200) at a maximum absorption wavelength (650 nm for the magenta toner, 500 nm for the cyan toner, and 600 nm for the yellow toner). The transparency was evaluated by light transmittance according to the following standards, where the light transmittance of the unprinted OHP film was made 100%. The evaluation results are given in Table 4.

A: 85% or more

B: 75 to 85%

C: 65 to 75%

D: less than 65%

[Transfer Efficiency]

A total of 50,000 copies were produced under normal temperature and low humidity conditions (23° C./5% RH) to evaluate transfer efficiency according to the following standards.

The images were transferred onto transfer papers by a color copier (Canon, CLC-1000), where potential contrast of the photosensitive member was adjusted in such a manner that the developer concentration of 0.6 mg/cm$^2$ on the photosensitive member. The image density of the image on the transfer paper and that remaining on the photosensitive member were analyzed by using a densitometer (X-RITE, X-RITE 500 Series). The developer was collected from the image on the transfer paper and the image remaining on the photosensitive member by taping, and the image density on the tape put on a paper was measured. The amount of the developer on the transfer paper or the photosensitive member was determined from the measured image density to determine image transfer efficiency. In this case, the transfer current was adjusted to obtain the highest transfer efficiency. Transfer efficiency was determined by the following formula:

$$\text{Transfer efficiency (\%)}=D2/(D1+D2)\times 100$$

where, D1 is the image density remaining on the photosensitive member, and D2 is the image density transferred to the paper, both on the tape put on a paper.

The transfer efficiency was evaluated according to the following standards. The evaluation results are given in Table 4.

(Evaluation Standards)

After a total of 50,000 copies are produced,

A: Transfer efficiency is 92% or more,

B: Transfer efficiency is 87 to 92%,

C: Transfer efficiency is 80 to 87%, and

D: Transfer efficiency is less than 80%.

[Evaluation of Fixation Properties]

The fixation temperature range was determined by using a color copier (Canon, CLC-1000) modified by removing the oil spreading device and by enabling free setting of fixation temperature. An unfixed, monochromic image was formed under normal temperature/normal humidity conditions (23° C./50% RH) on an A4 paper sheet (CLC-recommended SK80) at an image area ratio of 25%, where potential contrast of the photosensitive member was adjusted to achieve a toner density of 1.2 mg/cm$^2$. Fixation temperature was raised from 120° C. at intervals of 10° C., while the copier was operating under the normal temperature/normal humidity conditions (23° C./50% RH), to determine the allowable fixation temperature range, in which offset or winding failure would not occur. The evaluation results are given in Table 4.

Example 2

Two-component Cyan Developer 2 was prepared in the same manner as in EXAMPLE 1, except that Binder Resin 2 having a polyester unit was used as the binder resin to prepare Cyan Toner 2. The evaluation results are given in Table 4.

Example 3

Two-component Cyan Developer 3 was prepared in the same manner as in EXAMPLE 1, except that Binder Resin 3 having a polyester unit was used as the binder resin to prepare Cyan Toner 3. The evaluation results are given in Table 4.

Example 4

Two-component Cyan Developer 4 was prepared in the same manner as in EXAMPLE 1, except that Binder Resin 4 having a polyester unit and Wax (B) were used to prepare Cyan Toner 4. The evaluation results are given in Table 4.

Example 5

Two-component Cyan Developer 5 was prepared in the same manner as in EXAMPLE 1, except that Binder Resin 5 having a polyester unit and Wax (C) were used to prepare Cyan Toner 5. The evaluation results are given in Table 4.

Example 7

Two-component Cyan Developer 7 was prepared in the same manner as in EXAMPLE 1, except that Binder Resin 7 having a polyester unit and Wax (C) were used to prepare Cyan Toner 7. The evaluation results are given in Table 4.

Example 8

Two-component Magenta Developer 1 was prepared in the same manner as in EXAMPLE 1, except that C.I. Pigment Blue 15:3 as the colorant was replaced by C.I. Pigment Red 122 to prepare Magenta Toner 1. The evaluation results are given in Table 4.

Comparative Example 1

Two-component Cyan Developer 8 was prepared in the same manner as in EXAMPLE 6, except that Binder Resin 8 having a polyester unit was used to prepare Cyan Toner 8. The evaluation results are given in Table 4.

Comparative Example 2

Two-component Cyan Developer 9 was prepared in the same manner as in EXAMPLE 6, except that Binder Resin 9 having a polyester unit was used to prepare Cyan Toner 9. The evaluation results are given in Table 4.

Comparative Example 3

Two-component Cyan Developer 10 was prepared in the same manner as in EXAMPLE 7, except that Binder Resin 10 having a polyester unit was used to prepare Cyan Toner 10. The evaluation results are given in Table 4.

TABLE 4

| | | | | | | | Evaluation results | | | |
|---|---|---|---|---|---|---|---|---|---|---|
| | Toner No. | Binder Resin | Wax | Maximum endothermic peak temperature | Circularity | Light trans-mittance | Charge build-up characteristics | Trans-parency | Transfer efficiency | Allowable fixation temperature range (° C.) |
| Ex. 1 | Cyan Toner 1 | 1 | A | 73.2 | 0.935 | 30 | A | A | A | 130-200 |
| Ex. 2 | Cyan Toner 2 | 2 | A | 72.6 | 0.936 | 25 | B | A | A | 130-190 |
| Ex. 3 | Cyan Toner 3 | 3 | A | 72.9 | 0.935 | 35 | B | A | A | 140-210 |
| Ex. 4 | Cyan Toner 4 | 4 | B | 64.3 | 0.930 | 30 | B | B | B | 130-180 |
| Ex. 5 | Cyan Toner 5 | 5 | C | 110.3 | 0.930 | 30 | B | B | B | 120-170 |
| Ex. 7 | Cyan Toner 7 | 7 | C | 111.2 | 0.925 | 60 | C | C | C | 150-210 |
| Ex. 8 | Magenta Toner 1 | 1 | A | 73.2 | 0.935 | 30 | A | A | A | 130-200 |
| Ex. 9 | Yellow Toner 1 | 1 | A | 72.6 | 0.935 | 25 | A | A | A | 130-200 |
| Ex. 10 | Black Toner 1 | 1 | A | 73.0 | 0.934 | 33 | A | A | A | 130-200 |
| Com. ex. 1 | Cyan Toner 8 | 8 | B | 63.8 | 0.925 | 5 | D | D | C | 150-200 |
| Com. ex. 2 | Cyan Toner 9 | 9 | B | 63.3 | 0.926 | 15 | D | D | C | 150-200 |
| Com. ex. 3 | Cyan Toner 10 | 10 | C | 110.9 | 0.925 | 75 | D | D | C | 150-200 |

Example 9

Two-component Yellow Developer 1 was prepared in the same manner as in EXAMPLE 1, except that C.I. Pigment Blue 15:3 was replaced by C.I. Pigment Yellow 74 to prepare Yellow Toner 1. The evaluation results are given in Table 4.

Example 10

Two-component Black Developer 1 was prepared in the same manner as in EXAMPLE 1, except that C.I. Pigment Blue 15:3 was replaced by carbon black to prepare Black Toner 1. The evaluation results are given in Table 4.

Example 11

Cyan Toner 1, Magenta Toner 1, Yellow Toner 1 and Black Toner 1 were used to produce the full-color images. The images exhibited excellent color reproducibility, both on paper and OHP.

What is claimed is:

1. A color toner comprising at least a binder resin, a colorant and a release agent, wherein the binder resin has at least a polyester unit and is synthesized in the presence of tin 2-ethylhexanoate as a catalyst, wherein said color toner has an average circularity of 0.922 to 0.955 for the particles having a circle-equivalent diameter of 3 μm or more and said color toner has one or more absorption peaks in a temperature range from 30 to 200° C. and the largest peak at from 60 to 130° C. in a heat absorption curve, established by differential scanning calorimetry (DSC), said color toner has a light transmittance from 10 to 70% in an aqueous solution containing methanol 45% by volume.

2. The color toner according to claim 1, wherein the binder resin contains the polyester unit at 30% by weight or more based on the total weight of the binder resin.

3. The color toner according to claim 1, wherein the polyester unit is synthesized in the presence of the tin 2-ethylhexanoate as a catalyst, and incorporated at 0.01 to 2.0 parts by weight per 100 parts by weight of the binder resin.

4. A full-color image formed by developing a latent image with the color toner of claim 1.

5. The color toner according to claim 1, wherein said binder resin has at least a hybrid resin having a polyester unit and a vinyl polymer unit.

* * * * *